United States Patent [19]

Kudlacik et al.

[11] 4,032,874

[45] June 28, 1977

[54] REACTOR CORE

[75] Inventors: Henry W. Kudlacik; Robert L. Winchester, both of Schenectady, N.Y.

[73] Assignee: General Electric Company, Schenectady, N.Y.

[22] Filed: Aug. 26, 1975

[21] Appl. No.: 607,761

[52] U.S. Cl. ..... 336/60; 336/134; 336/210; 336/219

[51] Int. Cl.[2] ..... H01F 27/26

[58] Field of Search ..... 336/210, 132, 134, 178, 336/165, 60, 212, 214, 219

[56] References Cited

UNITED STATES PATENTS

| | | | |
|---|---|---|---|
| 1,574,640 | 2/1926 | Unger | 336/210 X |
| 1,877,317 | 9/1932 | Hitchcock | 336/134 X |
| 2,411,370 | 11/1946 | Fries | 336/134 X |
| 2,460,145 | 1/1949 | Pfuntner et al. | 336/134 |
| 2,835,876 | 5/1958 | Hammond | 336/134 |
| 3,155,932 | 11/1964 | Oberli | 336/214 X |
| 3,341,793 | 9/1967 | Wale et al. | 336/219 X |
| 3,436,707 | 4/1969 | Derbyshire et al. | 336/134 |

FOREIGN PATENTS OR APPLICATIONS

| | | | |
|---|---|---|---|
| 1,070,832 | 6/1967 | United Kingdom | 336/212 |

*Primary Examiner*—Thomas J. Kozma
*Attorney, Agent, or Firm*—John F. Ahern; James W. Mitchell

[57] ABSTRACT

A reactor core includes a plurality of laminations of trapezoidal shape forming the legs of the core. These legs are arranged in generally rectangular configuration with air gaps provided at the corners of the core. These air gaps extend diagonally of the core legs and are formed between the inclined faces of adjacent ends of the trapezoidal-shaped core legs. End plates each having a longitudinal section extending parallel to and fixed to one of the legs and having flanges at each end of the longitudinal section extending perpendicularly to the longitudinal section are provided for maintaining the legs of the core in assembled relation and for effecting adjustment of the air gaps. The end plates include elongated openings in the flanges thereof for permitting movement of each of the end plates, and the leg to which it is affixed, relative to the remainder of the core for varying the size of the diagonal air gaps. A plurality of metallic, non-magnetic spacers having substantially the same shape as the end plates are disposed at intervals between the end plates to separate the core laminations into groups. These spacers carry the magnetic forces tending to close the air gap. Fastening devices extend through the elongated openings and are loosened to permit movement of the end plate and its associated leg relative to adjacent legs for changing the size of the air gaps and then again tightened to hold the legs in the adjusted position. The fastening devices are accessible from the exterior of the reactor to facilitate convenient adjustment of the air gaps. Because of the separation of the laminations into groups to reduce the forces necessary to oppose magnetic forces tending to close the air gaps and also, due to the diagonal construction of the air gaps, which has the effect of reducing the flux density and therefore the magnetic force at the air gaps the fastening devices can be designed to maintain the legs in adjusted position without the need of air gaps blocking spacers in the air gaps. The air gaps, therefore, are available as passages for the flow of cooling gas for removal of heat from the reactor core.

6 Claims, 6 Drawing Figures

FIG. 1
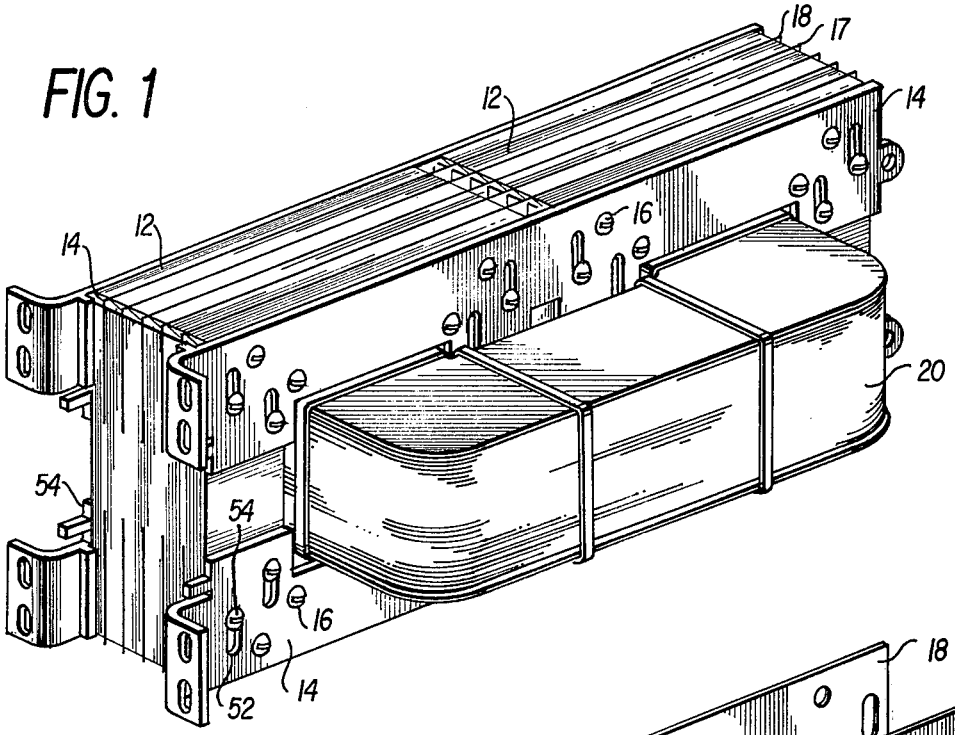
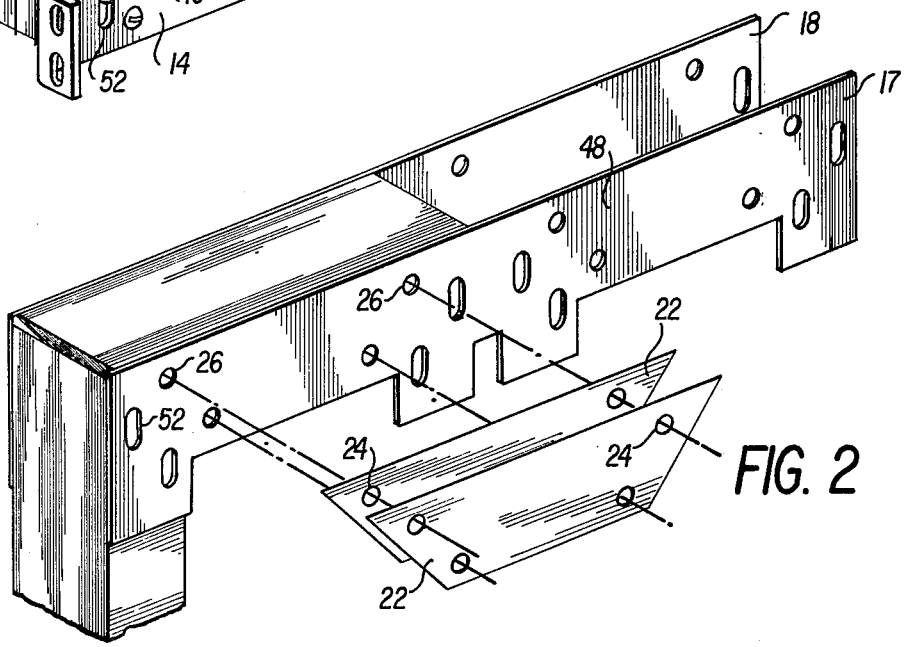
FIG. 2
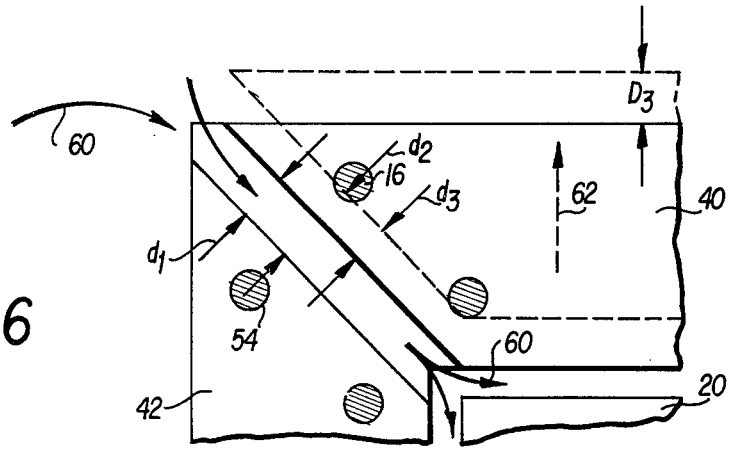
FIG. 6

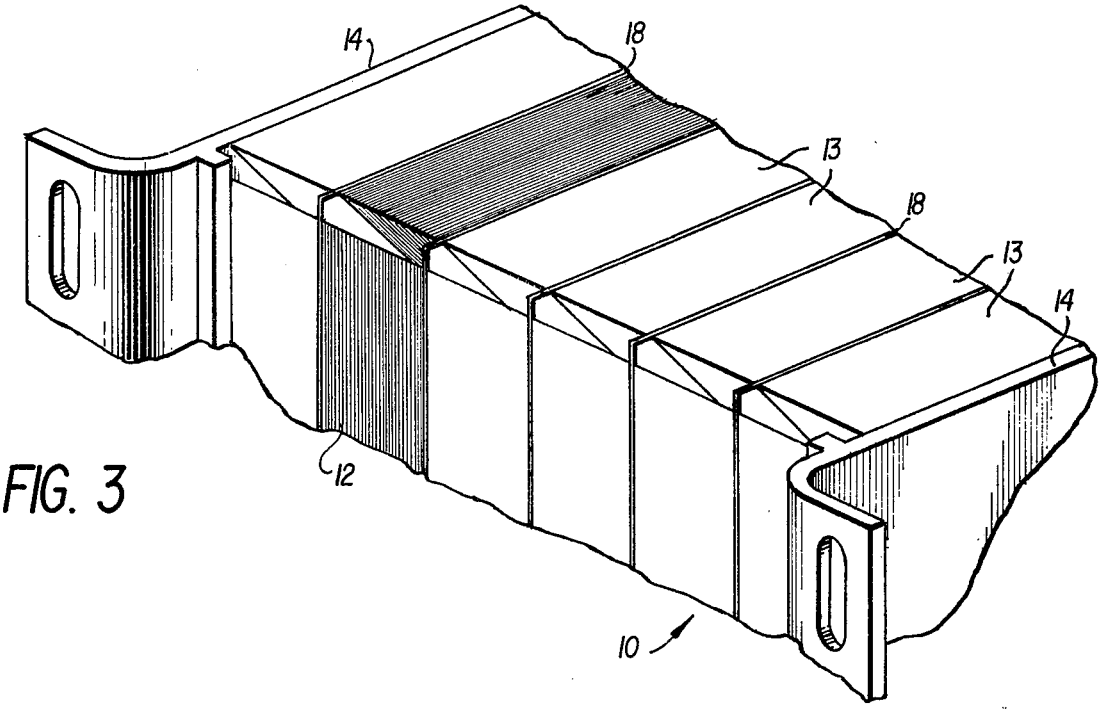
FIG. 3
FIG. 5
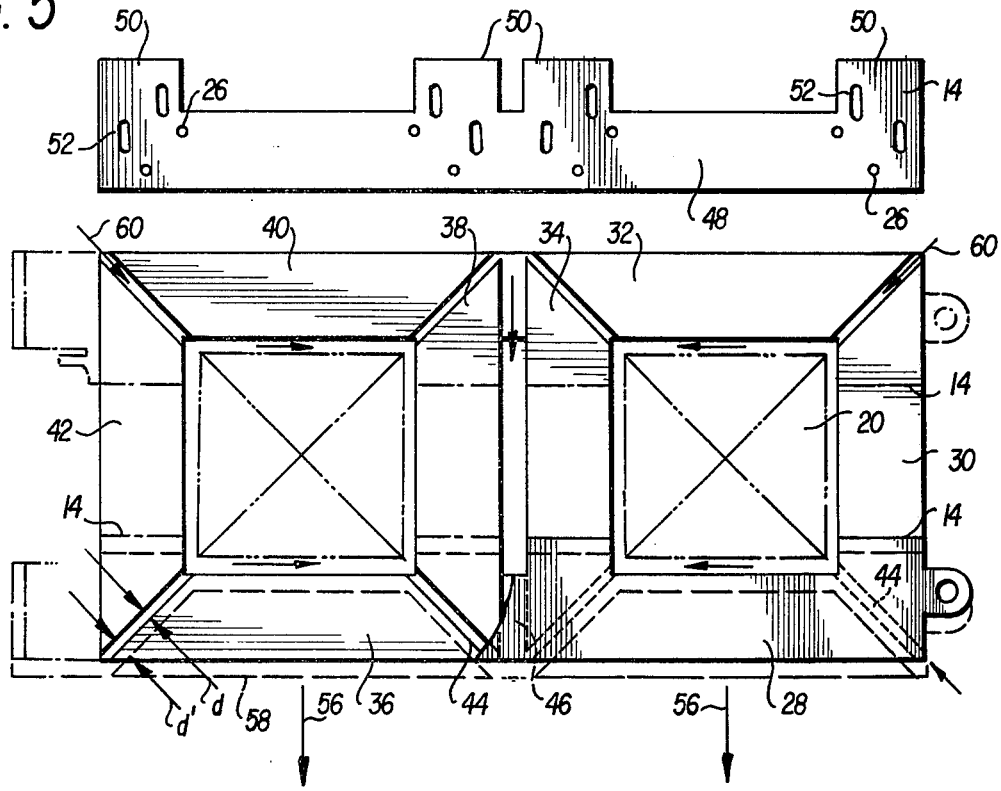
FIG. 4

REACTOR CORE

BACKGROUND OF THE INVENTION

1. Field of the Invention

This invention relates to reactor cores, for example cores for reactors used with rotating dynamoelectric machines, and more particularly to core clamping and air gap arrangements for such reactor cores.

2. Description of the Prior Art

The prior art discloses many examples of reactor cores composed of a plurality of laminations and in many cases having one or more air gaps arranged therein. Such reactor cores usually include a plurality of legs and the air gap or gaps are arranged in one or more of these legs. The gap is normally provided by spaced faces perpendicular to the leg in which the gap is located. The prior art also includes arrangements for adjusting the size of the gap to vary the reactance of the reactor of which the core is a part.

Such reactors may be used for example in connection with dynamoelectric machines. In this type of use such a reactor may be employed in series with each of the legs of a primary winding of an excitation transformer, the secondary of which may be in circuit with an SCR for controlling the field excitation of the dynamoelectric machine; for example, it may be used in a circuit such as that shown in U.S. Pat. No. 3,702,965, assigned to the assignee of the present invention.

Particularly in such uses involving relatively large currents the reactor core may have substantial magnetic flux therethrough and this flux tends to move the parts of the core on opposite sides of an adjustable air gap toward each other with substantial force. In order to counteract the effect of this force and maintain the desired air gap, some prior art structures have employed spacers of non-metallic material in the air gap which block the same.

However, such cores are also subject to development of substantial heat therein and it is necessary to circulate cooling gas through the core to effect removal of this excess heat. One convenient path for flow of such gas to remove excess heat is through the air gaps in the core but the inclusion of the aforementioned spacers blocks, or at least partially obstructs, the flow of gas, thereby reducing the cooling effectiveness. Additionally, such spacers cannot be relied upon, under heavy-duty conditions over a long period of time, as for example the uninterrupted operating cycle of an electric utility generator which may run for years without shutdown, to adequately perform the air gap maintenance function. In such installations with large air gaps intense heat is generated. Mechanical spacers are susceptible, under such conditions over such time periods, to deterioration and change of dimension. This can lead to clearances and loosening of the spacers, which in turn can lead to vibration of the magnetic parts, wear, and eventual failure of the reactor.

Moreover, the extent of cooling is also affected by the extent of the surface area of the opposed faces on opposite sides of the air gaps. In the usual prior art structure the gap has been formed so that these faces are perpendicular to the core leg and the surface area is therefore limited to the cross-sectional area of the leg. In accordance with the present invention the gap is formed to extend diagonally of the core leg thereby materially increasing the surface area of the faces on opposite sides of the gap and hence increasing the surface contacted by the cooling gas flowing through the gap to remove heat from the core.

The force tending to urge the parts of the reactor core on opposite sides of the gap toward each other is dependent upon the flux density at the gap. With prior art structures in which the gap is made so that the faces are perpendicular to the leg of the core there is a substantial flux density and hence a substantial force which has to be counteracted in order to maintain the gap at its desired size. With the diagonal air gap arrangement of the present invention the surrface area at the gap is materially increased and the flux density across the gap for a given flux density in the reactor core is correspondingly reduced, thereby reducing the force which must be counteracted in maintaining the gap size.

In such reactor cores it is desirable to provide means for adjusting the size of the gap in order to vary the reactance of the reactor of which the core is a part. In accordance with the present invention the adjustment is conveniently made by simply loosening fastening means accessible from the exterior of the reactor core making the desired adjustment and then tightening the fastening means to hold the parts in the adjusted position. Moreover, the aforementioned diagonal gap provides fine tuning in facilitating accurate adjustment of the gap.

Accordingly, it is a principal object of the invention to provide laminated core structure for inductive devices which has greater support in opposition to magnetic forces than was heretofore available.

It is another object of the present invention to provide a reactor core having an improved arrangement for adjusting an air gap therein.

It is still another object of this invention to provide a reactor core which requires no spacers in the air gap thereby leaving an unobstructed passage for flow of cooling gas.

It is a further object of this invention to provide a reactor core having an air gap arranged in a manner which reduces flux density across the gap and thereby reduces the force tending to urge the faces of the core leg on opposite sides of the gap toward each other.

It is still a further object of this invention to provide an air gap arranged so as to maximize the cooling surface provided by the gap.

It is a further object of this invention to provide an adjustable air gap arranged so as to achieve fine tuning in the adjustment of the gap.

It is a further object of this invention to provide simple and effective means accessible from the exterior of the core for effecting adjustment of the air gap.

SUMMARY OF THE INVENTION

The reactor core of this invention, in one form thereof, includes a plurality of laminations of magnetic material of trapezoidal shape arranged so as to form a reactor core component of generally rectangular or square configuration. The trapezoidal shape of the laminations forming the legs of the core provides air gaps at the corners which extend diagonally of the legs. End plates having a longitudinal section extending parallel to and fixed to the laminations forming one of the legs and flanges at each end thereof extending perpendicularly to the longitudinal section are provided for maintaining the legs of the core in assembled relationship and for effecting adjustment of the air gaps. Specifically, each end plate includes openings in the longitudinal section aligned with corresponding openings in a first leg of the core for receiving fastening devices to hold the end plate and the laminations of the first leg in firm, fixed relationship. The end plate includes in each of its flanges an elongated opening, each elongated opening extending in the direction of the corresponding one of the core legs adjacent to the first leg. Fastening devices extend through these elongated openings and corresponding aligned openings in the adjacent legs. The elongated openings permit the end plate and the first leg to be moved relative to the adjacent legs for adjusting the size of the air gaps between the ends of the first leg and the adjacent leg. A similar end plate is provided at the opposite side of the core for effecting variation in the size of the air gaps at the other corners of the core. Finally, and of major importance, in order to distribute shear forces between adjacent laminations and between end laminations and the end plates spacers of non-magnetic metallic material corresponding in shape to the shape of the aforementioned end plates are employed at intervals between groups of laminations to carry the magnetic forces tending to close the air gap. Because of the foregoing structural features of the reactor core for providing improved support against deformation by magnetic forces, no spacers need be employed between adjacent legs of the core, and the air gaps, therefore, provide unobstructed passages for the flow of gas for cooling the reactor core. Additionally, the same structure provides for adjustment of the air gaps of the core for optimum magnetic reluctance characteristics.

BRIEF DESCRIPTION OF THE DRAWINGS

FIG. 1 is a perspective view of a reactor incorporating the reactor core construction of this invention.

FIG. 2 is a perspective view, partially exploded, of a portion of the reactor core of FIG. 1 showing details of the construction.

FIG. 3 is a partial perspective view of one comer of a reactor core in accord with the invention illustrating one air gap, adjacent laminations and the relationship of the end plates and supporting spacers thereto.

FIG. 4 is a simplified schematic illustration of components of the reactor core for purposes of illustrating the manner of adjustment of the air gap.

FIG. 5 is a view of an end plate employed in the reactor core construction of this invention, and FIG. 6 is an enlarged view of one corner of the reactor.

DESCRIPTION OF THE PREFERRED EMBODIMENT

Referring to FIGS. 1, 2 and 3, illustrating one form of this invention, there is shown a reactor including a core generally designated by the numeral 10. The core includes a plurality of thin laminations 12 of magnetic material having thicknesses of the order of 0.010 to 0.015 inch which are stacked to form legs of the desired thickness. The laminations are held in assembled relationship to form the core by means of relatively thick (approximately 0.50 inch, for example) end plates 14. A plurality of fastening means, which in the form shown are bolts 16, are employed for holding the end plates and the laminations forming the legs of the core structue in assembled relationship. Bolts 16, associated with nuts (not shown), extend through aligned openings in the end plates and in the laminated legs of the core, each bolt and nut engaging end plates placed on opposite sides of the stacks of laminations for pressing the laminations and the end plates in firm, frictional assembled relationship. Spacers 18 of non-magnetic metallic material and corresponding in shape to the end plates, and having a thickness large as compared with the laminations 12, e.g., approximately 0.125 inch, for example, are employed at spaced intervals between groups of stacked laminations. A coil 20 encircles the central portion of the reactor core to complete the basic structure of the reactor.

Referring particularly to FIG. 2, each of the laminations which, in stacked form, make up the individual legs of the core 10 are of trapezoidal shape, as indicated at 22. Each of the laminations of trapezoidal shape includes a plurality of openings 24 which are arranged for alignment with corresponding openings 26 in the spacers and end plates. The bolts 16 extend through these aligned openings.

The general arrangement of the legs which make up the reactor core is best shown in the schematic illustration in FIG. 4. As there shown, in the preferred embodiment of this invention, the core is specifically formed of eight legs of stacked laminations arranged in two side-by-side core components, each composed of four such legs. For convenience in later description, the legs shown in FIG. 4 are designated by the numerals 28, 30, 32 and 34 forming one core component and by numerals 36, 38, 40 and 42 forming the second core component. The adjacent legs are assembled with the inclined ends of the trapezoids facing each other, thereby providing at ends of adjacent legs air gaps 44 extending diagonally of the core legs. The overall structure comprising the two core components as shown in FIG. 4, has the appearance of two rectangular core elements in side-by-side relationship. The adjacent legs 34 and 38 of the two core components are arranged in parallel spaced relationship to provide a passage 46 for flow of gas therethrough to assist in removing heat from the reactor core.

In accord with the present invention, unique and effective means are utilized to provide a core as generally described hereinbefore having unblocked diagonal air gaps which are adjustable and of great importance in which the core structure is well supported to resist the magnetic forces which tend to change the air gaps.

In regard to supporting the core structure, in lieu of the spacers or blocks inserted into the air gap in accord with the prior art, we rely upon compression of the laminations together between the respective end plates in order to produce frictional forces between adjacent laminations and end plates sufficient to oppose the magnetic forces seeking to draw the laminations together across the air gap. Since, however, the compressive force which is applied to create the opposing frictional (or shear) force is limited by requirements of avoiding deformation, the mechanical strength of the compressive means and other factors, we interpose a plurality of non-magnetic spacers 18 at appropriate intervals between end plates 14 to separate the laminations 12 into a plurality of groups 13 of laminations, preferably of equal thickness, each of which is subjected to a fraction of the magnetic forces across the entire gap. Thus in the absence of spacers 18, if a magnetic force of 12,000 pounds was applied by the magnetic flux to draw the laminations together and close the air gap and reduce the magnetic reluctance of the flux path, a compressible force sufficient to establish a frictional force of 12,000 pounds would be required to prevent deformation of the gap. Since the distribution of shear forces in such a situation places a maximum force of approximately half the total force between each end plate and its adjacent lamination, the compressive force would, in the absence of spacers, have to be sufficient to establish a frictional force of 6,000 pounds at each such interface, with lesser force applied to successive interfaces, and approaching zero force at the center of the lamination stack.

Since the spacers 18 bridge the gaps 44, the required compressive force to oppose the magnetic force is only a fraction of the total magnetic force. For example, if five spacers 18 are utilized, separating the laminations into six groups 13, then the compressive force required to prevent distortion of the core need only be that sufficient to produce a maximum frictional force of 1,000 pounds between adjacent laminations and end plates. Since the same frictional force exists throughout the laminated core, the necessary compressive force is reduced by a factor equal to the number of spacer utilized plus one (or the number of groups of laminations established).

In further accordance with the present invention, a simple and effective arrangement is provided for varying the size of some or all of the air gaps to adjust the reactance of the reactor. This is provided by employing end plates 14 of appropriate configuration and employing elongated openings at particlar portions of these end plates. Since the spacers, thus employed, are of the same general shape, but of lesser thickness, and utilize openings of the same configuration and positioning as those in the end plates, reference is made in the following description to FIG. 2 which illustrates spacers and FIG. 5 which illustrates an end plate (brackets and ears on the end plates, as shown in FIG. 1, have been omitted in FIG. 5 for simplicity) and the same numerals have been applied to corresponding openings in the spacers and end plates. Referring now to FIGS. 2 and 5, each end plate 14 (and spacer 18) is formed of a generally E-shape (except that the E has two central elements), and includes a longitudinal section 48 and a plurality of flanges 50 extending perpendicularly to the longitudinal section 48. A plurality of openings, previously designated by the numerals 26, are formed in the longitudinal section, these openings, as also previously indicated, being arranged for alignment with corresponding openings 24 in the laminations of trapezoidal shape. In addition one or more elongated openings 52 are formed in each of the flanges 50 of the end plates 14 and of the spacers 18. These elongated openings permit relative movement between the end plates and the legs of the core associated with the flanges of the end plates so as to vary the size of the air gaps as desired.

In providing for assembly of the elements to form the core and to provide for adjustment of the air gap, a pair of end plates 14, one on the top and one on the bottom of the stack of laminations, are assembled to legs 28 and 36 and fastened in fixed relation thereto by fastening devices or bolts 16 extending through aligned openings 24 in the trapezoidal-shaped laminations and openings 26 in the end plates and in the spacers 18 therebetween. When the bolts are tightened the end plates and the laminations forming the legs 28 and 36 are assembled in firm, fixed frictional relationship, adequately bound to prevent distortion of the air gaps.

Legs 30, 34, 38 and 42 are arranged, as shown in FIG. 4, extending perpendicularly to and spaced from the legs 28 and 36 to form air gaps 44 at the corners of the core components. This assembly is effected by fastening devices, such as bolts designated by 54 in FIG. 1, which extend through elongated openings 52 in the end plates and the spacers and also through aligned openings 24 in the trapezoidal-shaped laminations forming the legs 30, 34, 38 and 42. Similar end plates are employed on the opposite longitudinal side of the core and are similarly arranged in engagement with longitudinally extending legs 32 and 40 and perpendicularly related legs 30, 34, 38 and 42.

The elongated openings provide for movement of the end plates relative to the perpendicularly arranged legs 30, 34, 38 and 42, such movement, as limited by the elongated openings, being in the direction in which these legs extend, that is in a vertical direction in FIG. 4. Such movement provides for varying the size of the air gaps. Referring particularly to FIG. 4, the legs 28 and 36 in their solid line positions, as shown in that figure, are spaced from corresponding perpendicularly extending legs to provide air gaps 44 having a dimension indicated by *d*. If it is desired to adjust the air gaps at the lower corners of the core to provide a larger dimension *d'*, the bolts 54 connecting the end plates and the perpendicularly extending legs 30, 34, 38 and 42 are loosened. The elongated slots then permit movement of the end plates 14 together with the legs 28 and 36 fixed thereto in the direction of the arrows 56 to the dotted line position indicated by the numeral 58. As indicated in FIG. 4, this movement increases the dimension of the air gaps at all four lower corners from the original dimension *d* to the larger dimension *d'*, thereby varying the reactance of the reactor by the desired amount. The bolts 54 are then tightened, pressing the end plates, the laminations of the legs 30, 34, 38 and 42 and the spacers therebetween into firm frictional engagement for maintaining the legs in the adjusted position and hence for maintaining the adjusted air gaps.

Adjustment of the diagonal air gaps at the upper corner of the core structure shown in FIG. 4 is similarly effected by loosening the bolts 54 which hold the upper end plates and the perpendicularly extending legs 30, 34, 38 and 42 in assembled relationship, moving these end plates and the associated legs 32 and 40 to the desired adjusted position to establish the desired air gap and then tightening the bolts to hold the elements in assembled relationship. In the core structure of this invention, as can be seen in FIG. 1, the bolts 54 are accessible from the exterior of the assembled reactor so that adjustment of the air gaps may be conveniently and easily effected exteriorly of the reactor.

It will be apparent that while the embodiment illustrated includes two side-by-side core components each formed of four legs arranged in a generally rectangular, or more specifically square, configuration and while this is the embodiment specifically utilized in connection with the use of the reactor in certain dynamoelectric machines, other uses may be satisfied by employing only one of the side-by-side core components, for example a core component including only legs 28, 30, 32 and 34. Moreover, while in the embodiment illustrated and described, it is contemplated that adjustment will be provided for all eight air gaps, it may be sufficient in some applications to provide for adjustment of only some of the air gaps, for example those at the bottom corners; in this case only the legs 28 and 36 would be moved, leaving the legs 32 and 40 in a fixed non-adjustable position. If a single core component were employed, it would also be possible to limit the adjustment, for example, to the single leg 28, thereby varying only the two air gaps adjacent the ends of this leg. It would also be possible in some applications to make the legs 30, 32 and 34, for example, in a single unitary assembly or with the legs abutting so that no air gaps would be provided at the upper corners, leaving only adjustable air gaps at the lower corners. Finally, if desired only a single air gap could be employed. For example, the leg 28 could be arranged to abut the leg 34 providing only a gap at the right corner between legs 28 and 30. In that case adjustment would have to be effected by moving the leg 28 diagonally along abutting faces of the legs 28 and 34 to vary the air gap. It this last-described construction were employed, the elongated openings would have to be in line with the diagonal abutting faces of the legs 28 and 34 rather than in a vertical direction as illustrated in the embodiment described.

Thus, while there has been described in detail a preferred embodiment of the invention which is utilized in dynamoelectric machines it will be apparent that numerous modifications can be made in the particular structure depending on the reactance requirements and the degree of adjustment thereof which is considered necessary in a particular application.

In addition to the ease of adjustment of the air gap, the core structure of this invention provides additional advantages because of the particular arrangement of the air gap employed therein. One such advantage can best be understood by considering that the force between two magnetic surfaces tending to move the surfaces toward each other may be stated by the formula $$F = 0.01387\beta^2 \text{ lbs./sq. in.}$$

where $F$ is the force and $\beta$ is the flux density at the air gap in KL/sq. in. In reactors such as those employed in connection with large dynamoelectric machines can be quite large. For example, where $\beta$ is 100 KL/in.$^2$ F from the above formula would be 139 pounds per square inch. If the cross-sectional area of the air gap in a particular application is, for example, 6 inches by 12 inches or 72 square inches, the total force at the air gap would be approximately 10,000 pounds. This force, of course, must be opposed by the frictional engagement of the end plates and the laminations forming the legs of the core, the force causing the frictional resistance being provided by the fastening devices such as the bolts 16 and 54. The conventional method of opposing such forces to insure maintenance of the air gap is to place insulating spacers in the gaps to take the magnetic force in compression. However, it is convenient to employ the air gaps as passages for the flow of gas to effect removal of heat from the reactor, this heat in applications such as dynamoelectric machines being substantial because of the high currents flowing through the coil of the reactor. Insulating spacers in the gaps, however, tend to reduce or obstruct the flow of cooling gas through these passages and hence materially reduce or eliminate the effectiveness of such gaps for cooling purposes.

In accordance with the present invention these air gaps are maintained unobstructed, due to the interposition of non-magnetic metallic spacers which bridge the air gaps and separate the laminations of the core into groups, each of which is required to be subjected to a significantly lesser compressive force to produce frictional (or shear) forces sufficient to oppose the magnetic forces tending to draw the laminations together and close the air gaps. The necessary compressive force is further reduced by the location and size of the air gaps herein. Where, as in conventional prior art devices, the air gaps are formed transversely of the individual legs, for example, where a conventional E-core structure is employed, the flux density across the air gap corresponds to that in the core legs. In the structure of the present invention, however, the air gaps are specifically arranged diagonally of the legs thereby providing a materially greater surface. This correspondingly reduces the flux density across the air gap to a substantially lesser magnitude than that in conventional structures where the air gap extends transversely of the core legs. For example, considering the structure illustrated in FIG. 4 where the air gap extends at the 45° angle relative to the adjacent legs, the surface of the air gap is $\sqrt{2}$ times the surface available where a conventional air gap extending transversely of one of the legs is employed. This correspondingly reduces the flux density $\beta$. Since the force, as indicated by the above formula, varies as the square of the flux density the force per square inch with the structure of this invention will be one-half that of a conventional transversely extending air gap. Since the area is greater by the ratio of $\sqrt{2}$, the actual reduction in total force tending to move the legs toward each other in the structure of this invention will be in the ratio of $(1/\sqrt{2})$ compared to the force in a transversely extending air gap with the same cross section of core leg. In other words, the total force at the air gap in the core structure of this invention is approximately 7/10 of that encountered in conventional structures. Since, as indicated in the above illustration, this force with conventional structures may be in the order of 10,000 pounds the force would be reduced, in the applicants' structure, to 7,000 pounds. This correspondingly reduces the force which must be exerted to achieve the frictional relationship adequate to counteract this magnetic force and enables use to provide for maintenance of the established air gap without the need for utilization of insulating spacers which could interfere with or block flow of cooling gas through the passages provided by the air gaps. Thus, as shown in FIG. 5 and more clearly in the enlarged view of FIG. 6, there is an unobstructed path between adjacent legs, for example, legs 40 and 42 in FIG. 6, for flow of cooling gas in the direction of the arrows 60 through the air gap to remove heat from the core in that area and then around the coil 20. In practice, the reactor would normally be enclosed within a gas-tight casing and cooling gas would be directed by suitable gas circulating means through the passages provided by the air gaps. The cooling gas would, for example, be directed to the extreme corners of the core structure, as shown in FIG. 4 and flow in the general direction of the arrows 60. In addition to flowing through the air gaps and around the coil 20, cooling gas also passes through the passage 46 provided between the spaced central legs 34 and 38 of the core structure.

In addition to achieving unobstructed passages for flow of cooling gas through the air gaps, the diagonal air gap provides a greater surface area to be contacted by the cooling gas and hence more effective heat removal.

In addition to the advantages already discussed, the diagonal air gap arrangement of our core structure also provides fine tuning in the adjustment of the air gap.

This can be most clearly seen by reference to FIG. 6 which shows an enlarged view of a portion of the core structure. In FIG. 6 the leg 40 is shown in solid lines in position wherein the air gap has a dimension $d_1$ and in a dotted line position where the air gap has a larger dimension $d_2$. The change in the size of the air gap resulting from the movement of the leg 40 from its solid line position to its dotted line position is therefore measured by $d_2d_1$, that is the dimension indicated by the designation $d_3$ in FIG. 6.

To effect this change in the size of the air gap, the leg 40 has been moved in the direction of the arrow 62 by an amount indicated by the dimension $D_3$. It can be readily seen by visual comparison of the dimensions $D_3$ and $d_3$ that the movement of the leg 40 for effecting this adjustment of the air gap is significantly greater than the change in the size of the air gap itself. In the arrangement shown in FIG. 6, since the air gap is at a 45° angle the distance $D_3$ is $\sqrt{2}$ times the distance $d_3$. Since the change in the dimension of the air gap is, therefore, less than the movement of the leg 40 by this ratio, a finer tuning in the adjustment of the air gap can be achieved.

Finally, it can also be seen by reference to FIG. 6 that the reduction in the magnetic material of the core leg caused by the presence of the openings for the bolts 16 therein is less where the gaps are placed diagonally at the corners, as in the applicants' invention, than where openings for receiving fastening devices are placed transversely of the core leg in the conventional construction for holding laminations in assembled relationship.

While a particular reactor core construction has been shown and described as utilized in the use of the reactor with large dynamoelectric machines, other modifications, some of which have been discussed earlier in this specification, will occur to those skilled in the art. It is intended, therefore that the invention not be limited to the particular embodiments shown and described and that the appended claims should cover such modifications as fall within the spirit and scope thereof.

We claim:

1. A laminated air-gap core for a high current reactor comprising:

a. first and second respective oppositely disposed pairs of core legs forming a rectangle, each of said core legs being of a trapezoidal shape so as to define with adjacent legs a plurality of diagonal air gaps devoid of any solid spacers at respective corners of said rectangle;

b. a pair of end plates disposed along opposite sides of each of said first oppositely disposed pair of core legs and extending at right angles therefrom so as to partially extend along the sides of each of said second pair of oppositely disposed core legs and extending across the gaps defined by adjacent core legs and engaging the planar edges of said core legs in flat abutting frictional relationship;

c. each of said core legs comprising:

$c_1$. a plurality of very thin ferromagnetic laminations having said trapezoidal shape and being of a flat planar configuration both before assembly into said core and after assembly and compression therein;

$c_2$. a plurality of thick planar non-magnetic spacer members having substantially the same shape as said end plates interposed at regular intervals within said core engaging said laminations in flat abutting frictional relationship and separating said laminations of said core legs into a plurality of lamination groups, said spacer members operating to change the pattern of shear-resisting forces applied between said laminations during operation of said reactor so as to reduce the maximum shear-resisting forces between any lamination and any adjacent planar surface by a factor equal to the number of lamination groups created by the interpositioning of said spacer members;

d. means applying a substantially uniform compressive force to each of said first pair of oppositely disposed pair of core legs to apply to the laminations and spacer members thereof a compressive force sufficient to compress said laminations without deformation of the same, said compressive force being sufficient to apply frictional forces between said laminations, said end plates and said spacer members to resist the maximum shear force caused by electrical phenomena during operation of said reactor aid tending to close or deform said air gaps;

e. means applying a substantially uniform compressive force to each of said second pair of oppositely disposed pair of core legs to apply thereto a compressive force sufficient to establish without deformation of said laminations an equivalent frictional force as is applied to each of said first oppositely disposed pair of core legs.

2. The reactor core of claim 1 and further including two of said rectangular arrays of oppositely disposed first and second pairs of core legs in side-by-side relationship, said core legs being compressed together between end plates which extend over and compress therebetween the laminations of said two rectangular core arrays.

3. A laminated air-gap core for a high current reactor comprising:

a. first and second respective oppositely disposed pairs of core legs forming a rectangle, each of said core legs being of a trapezoidal shape so as to define with adjacent legs a pluralitly of diagonal air gaps devoid of any solid spacer at respective corners of said rectangle;

b. a pair of end plates disposed long opposite sides of each of said first oppositely disposed pair of core legs and extending at right angles therefrom so as to partially extend along the sides of each of said second pair of oppositely disposed core legs extending across the gaps defined by adjacent core legs and engaging the planar edges of said core legs in flat abutting frictional relationship;

c. each of said core legs comprising:

$c_1$. a plurality of very thin ferromagnetic laminations having said trapezoidal shape and being of a flat planar configuration both before assembly into said core and after assembly and compression therein;

$c_2$. a plurality of thick planar non-magnetic spacer members having substantially the same shape as said end plates interposed at regular inervals within said core engaging said laminations in flat abutting frictional relationship and separating said laminations of said core legs into a plurality of lamination groups, said spacer members operating to change the pattern of shear-resisting forces applied between said laminations during operation of said reactor so as to reduce the maximum shear-resisting force between any lamination and any adjacent planar surface by a factor equal to the number of lamination groups created by the interpositioning of said spacer members;

d. means applying a substantially uniform compressive force to each of said first pair of oppositely disposed pair of core legs to apply to the laminations thereof a compressive force sufficient to compress said laminations without deformation of the same, said compressive force being sufficient to apply frictional forces between said laminations, said end plates and said spacer members to resist the maximum shear force caused by electrical phenomena during operation of said reactor aid tending to close or deform said air gaps;

e. means applying a substantially uniform compressive force to each of said second pair of oppositely disposed pair of core legs to apply thereto a compressive force to establish without deformation of said laminations an equivalent frictional force as is applied to said first oppositely disposed core legs, and f. means for adjusting the position of said second oppositely disposed pair of core legs relative to said first oppositely disposed pair of core legs to thereby adjust the dimension of said diagonal air gaps.

4. The reactor core of claim 3 and further including two of said rectangular arrays of oppositely disposed first and second pairs of core legs in side-by-side relationship, said core legs being compressed together between end plates which extend over and compress therebetween the laminations of said two rectangular core arrays.

5. A laminated air-gap core for a high current reactor comprising:

a. first and second respective oppositely disposed pairs of core legs forming a rectangle, each of said core legs being of a trapezoidal shape so as to define with adjacent legs a plurality of diagonal air gaps devoid of any solid spacers at respective corners of said rectangle;

b. a pair of end plates disposed along opposite sides of each of said first oppositely disposed pair of core legs and extending at right angles therefrom so as to partially extend along the sides of each of said second pair of oppositely disposed core legs and extending across the gaps defined by adjacent core legs and engaging the planar edges of said core legs in flat abutting frictional relationship;

$b_1$. said end plates having a plurality of discrete apertures therein aligned with discrete apertures in each of said first oppositely disposed pair of core legs adapted to receive therein a first set of compression bolts and a plurality of slotted apertures therein aligned with discrete apertures in each of said second oppositely disposed pair of core legs and adapted to receive therein a second set of compression bolts;

c. each of said core legs comprising:

$c_1$. a plurality of very thin ferromagnetic laminations having said trapezoidal shape and said discrete apertures therein and being of a flat planar configuration both before assembly into said core and after assembly and compression therein;

$c_2$. a plurality of thick planar non-magnetic spacer members having substantially the same shape as said end plates interposed at regular intervals within said core engaging said laminations in flat abutting frictional relationship and separating said laminations of said core legs into a plurality of lamination groups, said spacer members operating to change the pattern of shear-resisting forces applied between said laminations during operation of said reactor so as to reduce the maximum shear-resisting force between any lamination and any adjacent planar surface by a factor equal to the number of lamination groups created by the interpositioning of said spacer members;

d. means applying a substantially uniform compressive force to said first pair of oppositely disposed pair of core legs and incluing said first set of compression bolts and mating nuts therefor to apply to the laminations thereof a compressive force sufficient to compress said laminations without deformation of the same, said compressive force being sufficient to apply frictional forces between said laminations, said end plates and said spacer members to resist the maximum shear force caused by electrical phenomena during operation of said reactor and tending to close or deform said air gaps;

e. means applying a substantial uniform compressive force to said second pair of oppositely disposed core legs, said means including said second set of compression bolts and mating nuts therefor to apply thereto a compressive force to establish without deformation of said laminations an equivalent frictional force to that applied to said first oppositely disposed pair of core legs by said first set of compression bolts and nuts; and f. means for adjusting the position of said second oppositely disposed pair of core legs relative to said first oppositely disposed pair of core legs by means of the position of said second set of compressive bolts in said slotted apertures in said end plates and said spacer members thereby to adjust the dimension of said diagonal air gaps.

6. The reactor core of claim 5 and further including two of said rectangular arrays of oppositely disposed first and second pairs of core legs in side-by-side relationship, said core legs being compressed together between end plates which extend over and compress therebeteween the laminations of said two rectangular core arrays.

* * * * *